United States Patent [19]

Gijrath et al.

[11] Patent Number: 5,003,218

[45] Date of Patent: Mar. 26, 1991

[54] COLOR DISPLAY TUBE AND METHOD OF MANUFACTURING SUCH A COLOR DISPLAY TUBE

[75] Inventors: Johannes H. N. Gijrath; Jean Winters, both of Eindhoven, Netherlands

[73] Assignee: U.S. Philips Corporation, New York, N.Y.

[21] Appl. No.: 334,659

[22] Filed: Apr. 6, 1989

[30] Foreign Application Priority Data

Apr. 7, 1988 [NL] Netherlands ..... 8800883

[51] Int. Cl.[5] ..... H01J 9/18; H01J 29/07

[52] U.S. Cl. ..... 313/406; 313/407; 445/30; 445/37

[58] Field of Search ..... 313/406, 407; 445/30, 445/37

[56] References Cited

U.S. PATENT DOCUMENTS

| | | | |
|---|---|---|---|
| 4,644,222 | 2/1987 | Brunn | 313/406 |
| 4,663,561 | 5/1987 | Brunn | 313/406 |
| 4,763,039 | 8/1988 | Van Rens et al. | 313/406 |

*Primary Examiner*—Palmer C. DeMeo
*Attorney, Agent, or Firm*—John C. Fox

[57] ABSTRACT

A color selection electrode is suspended in a color display tube from pins which are provided in the corners of the display window. The suspension means comprise a resilient element which is secured to the color selection electrode, and a slide plate slidably secured relative to the flat resilient element rigidly secured to the pin. During the suspension the position of the color selection electrode is adjusted, and the slide plate is rigidly secured to the resilient element.

16 Claims, 4 Drawing Sheets

COLOR DISPLAY TUBE AND METHOD OF MANUFACTURING SUCH A COLOR DISPLAY TUBE

BACKGROUND OF THE INVENTION

The invention relates to a colour display tube comprising an envelope having a substantially rectangular display window which is provided with an upright edge, and a substantially rectangular colour selection electrode having a great number of apertures, which electrode is suspended from pins secured in the upright edge of the display window by means suspension means, each of which means comprises a resilient element which is fixedly connected to the colour selection electrode, and a slide plate having an aperture which is rigidly secured to the resilient element, each pin having a free end portion which partly projects from the aperture in the slide plate.

The invention also relates to a method of manufacturing such a colour display tube.

Such a colour display tube is known from British Patent Specification 2,097,996. Therein, each suspension means comprises a wire spring which is connected at one end to the colour selection electrode and at the other end urges the flat resilient element onto the free end portion of the pin. During the suspension of the colour selection electrode, the slide plate is slidably secured relative to the flat resilient element, the wire spring being necessary to retain the slide plate before it is rigidly secured to the flat resilient element.

In order to obtain a proper suspension of the colour selection electrode, the wire spring must firmly urge the flat resilient element onto the free end portion. This pressure should be sufficiently large that in the case of vibrations or shocks the colour selection electrode is not subject to an unfavourable change in position. Since the wire spring is secured to the colour selection electrode at one end, the colour selection electrode may be subject to deformation when the pressure exerted by the wire spring is too large. For this reason, a wire spring having a limited pressure is used in practice, the disadvantage thereof being, however, that in the case of vibrations and shocks the colour selection electrode may assume a position which differs from that when the colour selection electrode is properly suspended.

OBJECTS AND SUMMARY OF THE INVENTION

It is an object of the invention to provide a colour display tube in which the colour selection electrode can be readily suspended in an accurate and stable manner, and in which substantially no deformations occur in the colour selection electrode.

For this purpose, a colour display tube of the type mentioned in the opening paragraph is characterized according to the invention, in that the slide plate is rigidly secured to the relevant pin. Since the resilient element is fixedly attached to the colour selection electrode and the slide plate is rigidly secured to the relevant pin without making use of a spring, the colour selection electrode and the display window in which the former is suspended, form a unity. Consequently, they react identically to any vibrations and the colour selection electrode remains accurately suspended in the case of vibrations and shocks. For this purpose, the resilient element should be sufficiently rigidly secured to the colour selection electrode, preferably by (laser) welding.

In a preferred embodiment of a method according to the invention, in the manufacture of the colour display tube, the slide plate is slidably retained relative to the resilient element during the suspension of the colour selection electrode by providing the slide plate, with bent tags which fit with clearance in apertures formed in the resilient element. In this manner deformation the colour selection electrode differences in position between the free end portions and the apertures in the slide plate is prevented during the suspension of the colour selection electrode.

According to another preferred embodiment of the invention, each slide plate comprises an at least partly conical portion having an aperture on at least one side of this portion, and the free end portion of the relevant pin projects from this aperture and lies against the conical portion to which it is rigidly secured. Thus, a stable suspension of the colour selection electrode in the display window is attained, so that the negative effect of vibrations and shocks on the suspension is reduced.

To ensure that the colour selection electrode is accurately and stably suspended in the display window, it is important for the free end portion of the pin to lie properly against the slide plate before rigidly securing the slide plate to the pin. In another preferred embodiment of a colour display tube according to the invention, this is realized in that the free end portion of each pin is rotationally symmetrical, e.g., spherically shaped, so that the free end portion of each pin lies suitably against the associated slide plate, resulting in a proper fixation of the pin to the resilient element.

The aperture in the slide plate, from which the free end portion of the pin partly projects, may be situated either within or outside the surface of the resilient element.

A further preferred embodiment of a colour display tube according to the invention, however, is characterized in that each resilient element is provided with a further aperture which is covered by the slide plate on the side facing the free end portion of the relevant pin, the aperture in the slide plate and the further aperture in the resilient element being located opposite one another. Due to this, the slide plate not only lies against the free end portion but it also lies suitably against the resilient element. The slide plate can then be rigidly secured to the resilient element in a readily conceivable manner, for example, by (laser) welding.

According to a further preferred embodiment of a colour display tube of the invention the apertures formed in each resilient element and in which the bent tags of the slide plate fit are slot-shaped, the longitudinal axis of the apertures extending in a plane which is perpendicular to the longitudinal axis of the colour display tube. Due to this, the slide plate can be displaced during suspension in a plane which extends perpendicularly to the longitudinal axis of the colour display tube, thus compensating for tolerances caused by a possible movement of the colour selection electrode relative to the pins in this plane, the position of the colour selection electrode relative to a display screen on a display window thus remaining substantially unchanged.

In practice it has been found that during the suspension of the colour selection electrode, the slide plate can be slidably secured to the resilient element in a simple manner if each slide plate is provided with two bent tags and a supporting portion.

In a preferred embodiment of a colour display tube according to the invention, the colour selection electrode is stably suspended from the pins in that the resilient element is fixedly connected to the colour selection electrode at an angle, such that the resilient element exerts a suitable pressure on the relevant pin.

To preclude pressure-induced plastic deformations in the resilient element, the resilient element is preferably provided with limbs by means of which the resilient element is secured to the colour selection electrode. Due to the use of limbs, the resilient element becomes more flexible. The limbs should be shaped such that a sufficient degree of rigidity is ensured.

Acccording to another aspect of the invention, a method of manufacturing a such colour display tube comprising an envelope with an upright edge having pins secured in its corners, and a substantially rectangular colour selection electrode in which a great number of apertures is formed, which colour selection electrode is provided with suspension means each of which comprises a resilient element secured to the colour selection electrode and a slide plate in which an aperture is formed, each pin having a free end portion for suspending the colour selection electrode in the corners of the upright edge which, in practice, permits the colour selection electrode to be rapidly, stably and in which apertures are formed in the resilient element, the slide plate is provided with tags, the slide plate is slidably secured relative to the resilient element, the tags of the slide plate fitting with clearance in the apertures of the resilient element, the colour selection electrode is suspended in the display window, such that the free end portion of each pin projects from the aperture in each associated slide plate, the slide plate is rigidly secured to the associated resilient element, and each slide plate is rigidly secured to the relevant pin.

BRIEF DESCRIPTION OF THE DRAWINGS

The invention will now be explained in greater detail in terms of a few embodiments and with reference to the drawing in which.

DESCRIPTION OF PREFERRED EMBODIMENTS

Figure 1:
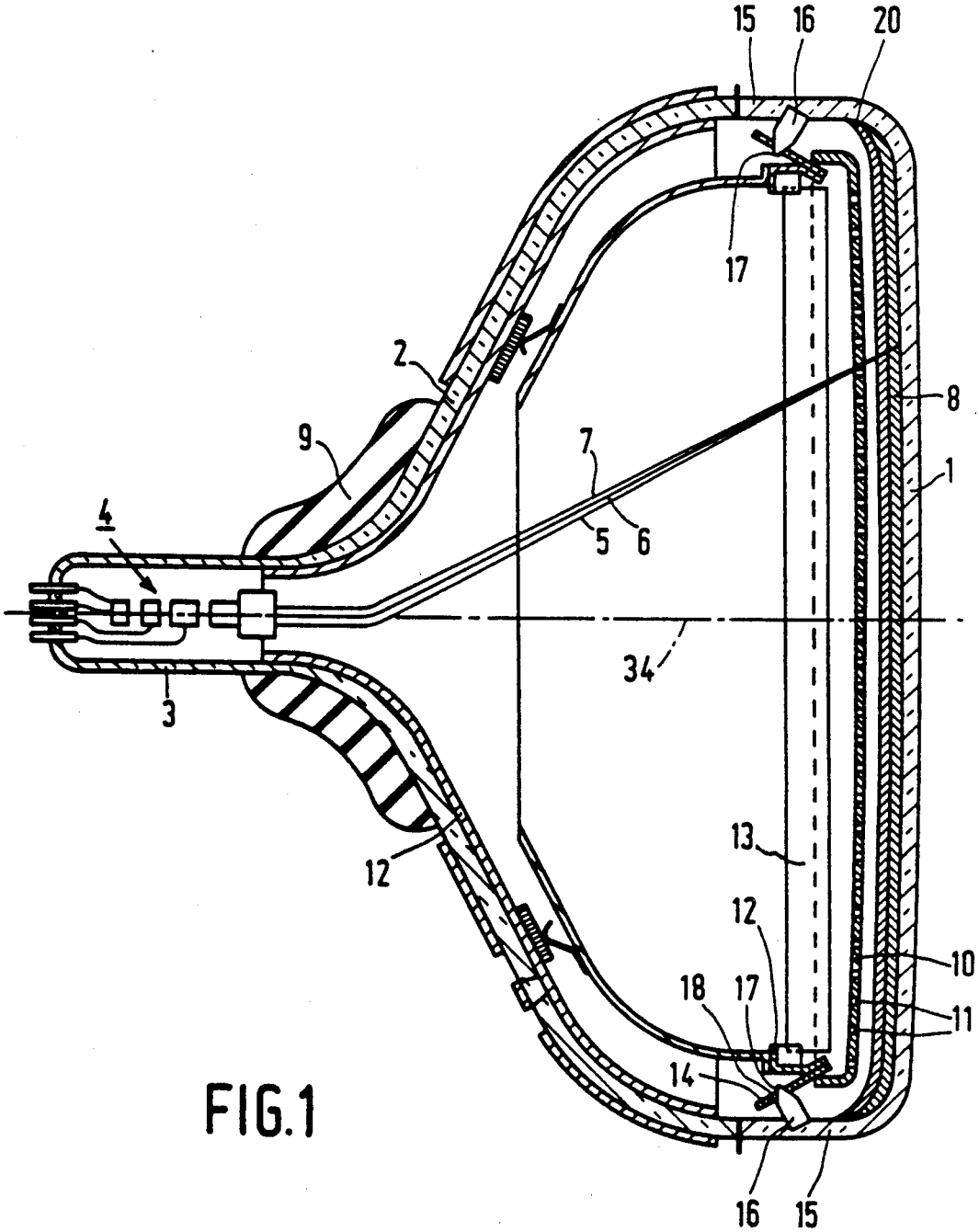
FIG. 1 is a sectional view of a colour display tube according to the invention.

FIG. 1 is a horizontal sectional view of a colour display tube comprising an envelope having a substantially rectangular display window 1, a cone 2, and a neck 3. The neck 3 accommodates an electrode system 4 having three electron guns for generating three electron beams 5,6 and 7. The electron beams are generated in one plane (the plane of the drawing) and are directed towards a display screen 8 which is provided on the inside of the display window 1 and which is composed of a large number of red, green and blue luminescing phosphor elements which are covered with an aluminium layer 20. The phosphor elements may be, for example, in the form of dots or strips, the longitudinal direction of which extends perpendicularly to the plane through the electron guns. On their way to the display screen 8, the electron beams 5,6 and 7 are deflected across the display screen 8 by deflection coils 9 which are coaxially arranged about a longitudinal axis 34 of the colour display tube, and the electron beams pass through a colour selection electrode 10 which is composed of a thin metal plate having apertures 11 whose longitudinal direction is parallel to that of the phosphor strips of the display screen 8. The three electron beams 5,6 and 7 pass through the apertures 11 at a small angle with each other and, consequently, they are each incident on phosphor elements of one colour.

Figure 2:
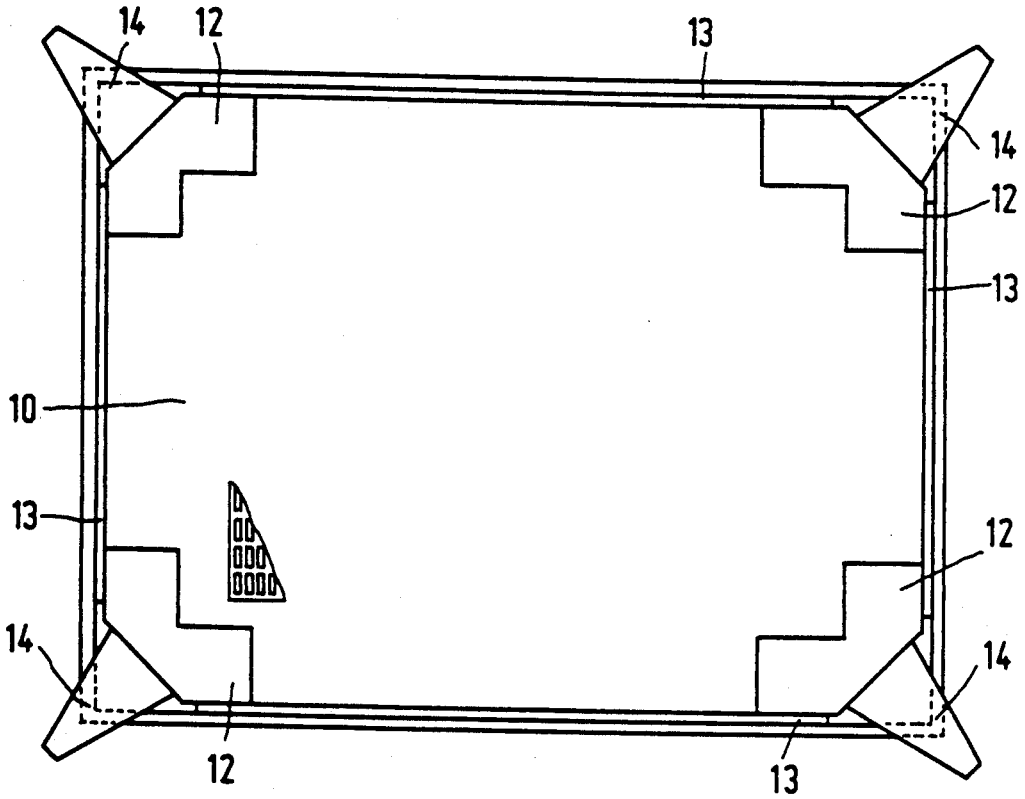
FIG. 2 is an elevational view of a colour selection electrode secured to a frame for mounting in the tube of FIG. 1.

Referring now to FIG. 2, the colour selection electrode 10 is secured to a frame comprising, for example, four individual portions 13 secured to each other by supporting strips 12, so that a sufficiently solid frame is formed. The supporting strips 12 may have many shapes, provided that the individual portions 13 can be secured thereto.

To preclude differences in expansion between the colour selection electrode 10 and the frame, they are both made from the same material and they are of approximately the same thickness.

Figure 3:
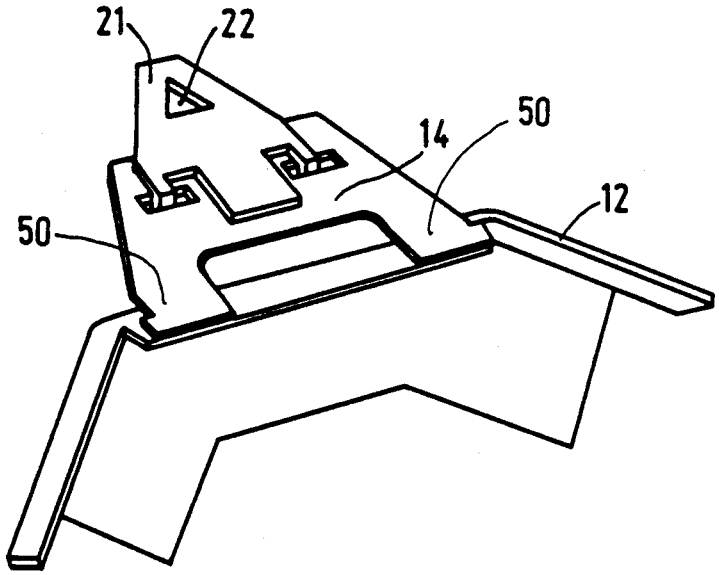
FIG. 3 is a perspective view of a suspension means for the mask of FIG. 2.

A resilient element, in the present embodiment a flat resilient element 14, which extends substantially perpendicularly to the electron beams deflected towards the relevant corner, is secured to each supporting strip 12. The flat resilient element should be secured in such a manner that a sufficient degree of rigidity is ensured, so that the colour selection electrode, frame and the resilient element can be regarded as one vibration system. Preferably, they are secured to one another by (laser) welding. Referring now to FIG. 3, a slide plate 21 having an aperture 22 is rigidly secured to the flat resilient element 14 , for example, by laser welding.

The display window 1 is provided with an upright edge 15 (FIG. 1), in the corners of which pins 16 are secured, for example, by fusing or thermocompression, the pins having a free end portion 17. After mounting, the free end portion 17 of each pin partly projects from the aperture 22 in the associated slide plate. For example, if the free end portion 17 of the pin 16 is conically shaped and the aperture 22 in each slide plate 21 is triangularly shaped (FIG. 3), the slide plate 21 lies against the free end portion 17 at three contact points. Each slide plate 21 is rigidly secured to the relevant pin 16, for example, by laser welding at the location of the three contact points. Due to the fact that the slide plate is rigidly secured to the relevant pin, the colour selection electrode frame assembly and the display window in which it is suspended form a unity, so that they react identically to vibrations. Because of this, the colour selection electrode remains accurately suspended and vibrations and shocks cause substantially no deformations in the colour selection electrode.

Figure 4:
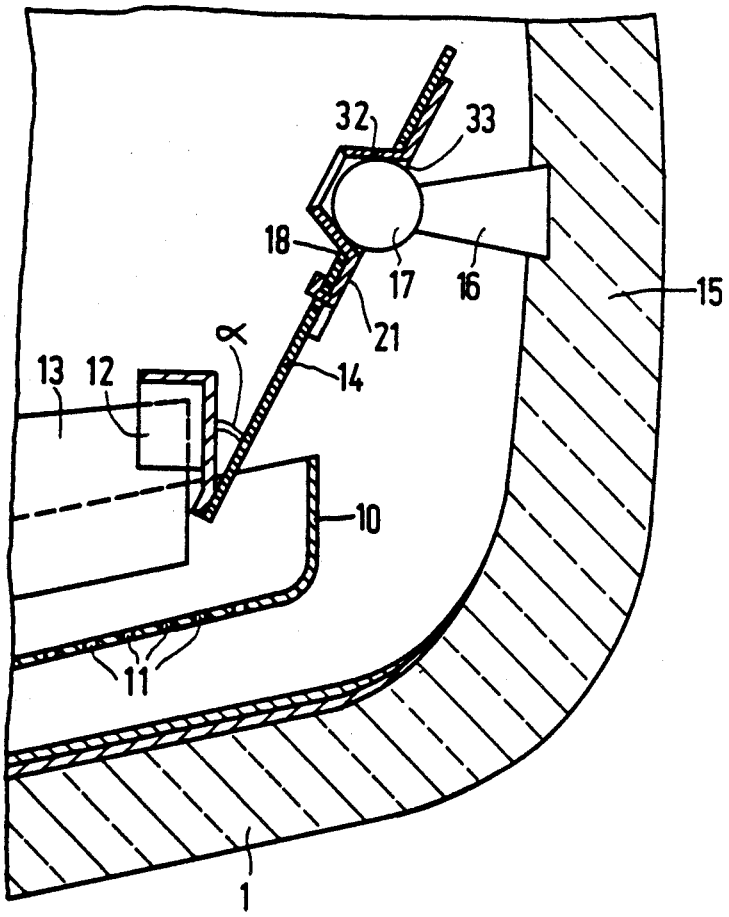
FIG. 4 is a sectional view of a portion of a tube like that of FIG. 1 showing a preferred embodiment of a mask suspension assembly according to the invention.

FIG. 4 is a sectional view of another preferred embodiment of a colour display tube according to the invention, in which an aperture 18 is formed in each flat resilient element 14. Each slide plate 21 is provided with an at least partly conical portion 32 having an conical portion 32. The aperture 33 of the slide plate projects through the aperture 18 in the flat resilient element. The pin 16 lies with its preferably spherically shaped free end portion 17 against the conically shaped portion 32 and is rigidly secured thereto, for example, by laser welding. In this manner, a stable suspension of the colour selection electrode in the display window is obtained. Consequently, the influence of vibrations and shocks on the suspension is even more reduced.

The colour selection electrode must be suspended in an accurate and stable manner, not only to reduce the number of deformations in the colour selection electrode to a minimum during operation of the colour display tube, but also during the manufacture of the colour display tube. To achieve this, the slide plate is slidably secured relative to the flat resilient element during the suspension of the colour selection electrode. The function of the slide plate will be explained with reference to FIG. 5.

Figure 5:
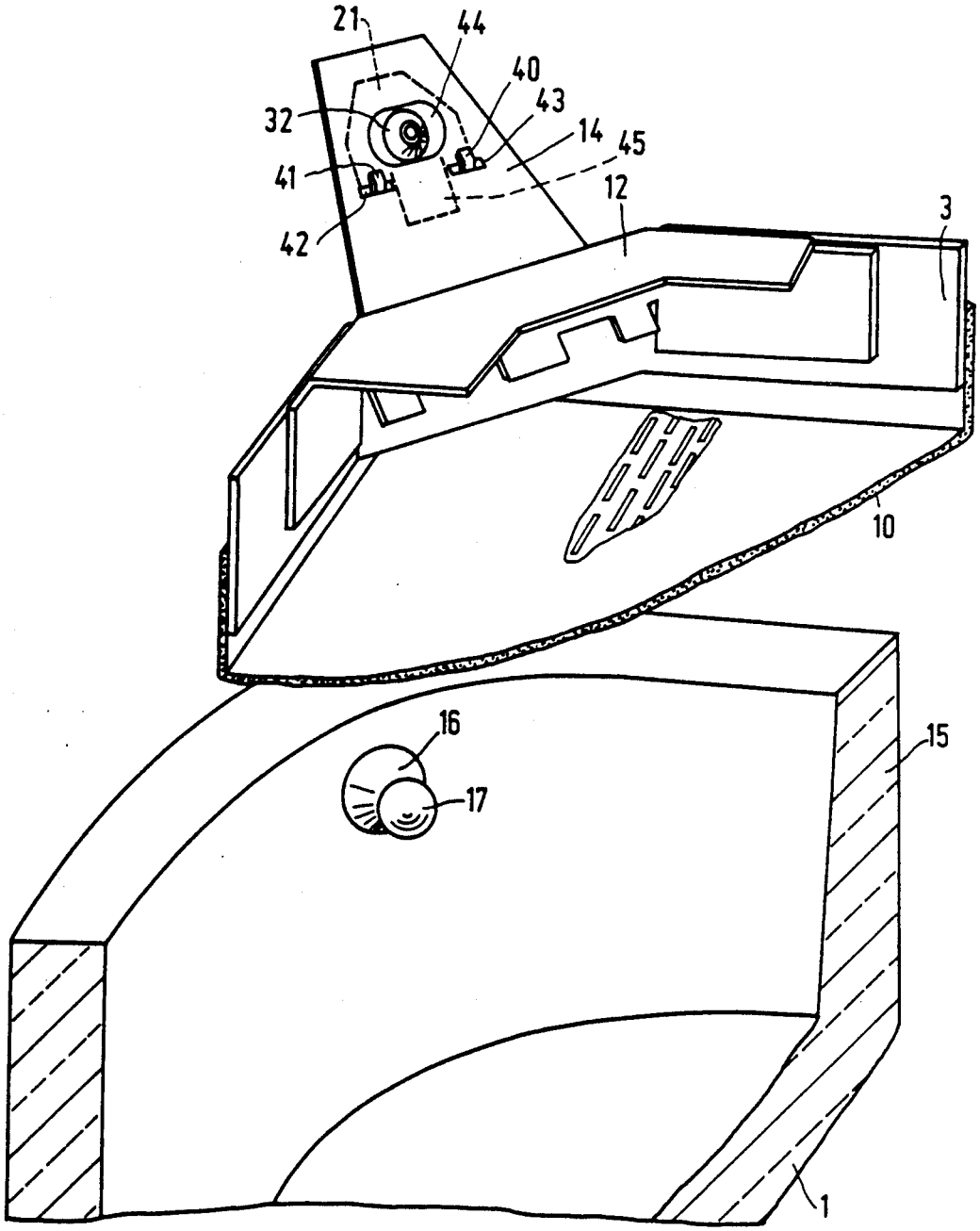
FIG. 5 is a perspective diagrammatic and expanded view of the preferred embodiment of FIG. 4 according to the invention.

A pin 16 is provided in each of the corners (only one of which is shown in FIG. 5) of the upright edge 15 of the display window 1. Subsequently, the frame 13 with the flat resilient element 14 which is secured to each supporting strip 12 and the slide plate 21 are provided on the spherical free end portion 17 of the pin 16. Each slide plate 21 preferably has two bent tags 40,41 which engage in two slotted apertures 42,43 in the flat resilient element 14, and a supporting member 45. The slide plate 21 has a conical portion 32 which engages the slotted aperture 44 of the flat resilient element. The slotted apertures 42, 43, 44, the longitudinal directions of which preferably extends in planes perpendicular to the longitudinal axis of the colour display tube, ensure that the slide plate 21 can be moved readily relative to the flat resilient element 14 in a plane perpendicular to the longitudinal axis of the colour display tube. In this manner deformations in the colour selection electrode during its suspension due to differences between the position of the free end portions and the apertures in the slide plate is precluded. Moreover, tolerances caused by a possible movement of the colour selection electrode relative to the pins in a plane perpendicular to the longitudinal axis of the colour display tube are compensated for in this manner, the position of the colour selection electrode relative to a display screen substantially remaining unchanged. After positioning the slide plate 21 on the pin 16, the slide plate 21 is rigidly secured to the flat resilient element 14, for example, by laser welding. To obtain a proper fixation and to enable welding, a sufficiently large supporting member 45 is advantageously used. For this purpose, it is advantageous for the slide plate 21 to lie properly against the flat resilient element 14, which is preferably attained by positioning the slide plate 21 on the side facing the free end portion 17.

After the slide plate has been rigidly secured to the flat resilient element, the display screen is provided on the display window by means of a photolithographic exposure process. Prior to this, the colour selection electrode is suspended in the display window several times. In order to obtain a stable suspension of the colour selection electrode, the flat resilient elements should exert a specific pressure on the pins. A suitable pressure is obtained by adapting the magnitude of the angle $\alpha$ (see FIG. 4) at which the flat resilient element is secured to the supporting strip. The occurrence of pressure-induced plastic deformations in the flat resilient element 14 (see FIG. 3) is precluded by providing the flat resilient element with limbs 50 by means of which the flat resilient element is secured to the frame. The shape of the limbs, which determines their flexibility, should on the one hand preclude any plastic deformation caused by pressure, and on the other ensure that the flat resilient element is secured to the colour selection electrode with a suitable rigidity. The invention is not limited to the embodiment of the limbs 50 as shown in FIG. 3 but also includes other embodiments by means of which the above-mentioned compromise can be realized.

When the display screen is ready, the slide plate is rigidly secured to the free end portion of the pin, for example, by laser welding.

It will be obvious that within the scope of the invention many variations are possible to those skilled in the art.

We claim:

1. In a colour display tube comprising an envelope having a substantially rectangular display window which is provided with an upright edge, and a substantially rectangular colour selection electrode having a plurality of apertures therein, the electrode suspended from pins secured in the corners of the upright edge of the display window by suspensions means, each of which means comprises a resilient element which is fixedly connected to a frame for the colour selection electrode, the means further comprising a slide plate having an aperture therein and being rigidly secured to the resilient element, each pin having a free end portion which partly projects from the aperture in the slide plate, the colour selection electrode being rigidly secured to the free end portion of the relevant pin via the slide plate, the improvement wherein the slide plate is provided with bent tags, and the resilient element comprises apertures therein in which the bent tags fit with clearance.

2. A colour display tube as claimed in claim 1, characterized in that each slide plate aperture is defined by an at least partly conical portion, the free end portion of the relevant pin lying against the conical portion.

3. A colour display tube as claimed in claim 2, characterized in that, the free end portion of each pin is spherically shaped.

4. A colour display tube as claimed in claim 3, characterized in that each resilient element is provided with a further aperture through which at least the partly conical portion of the associated slide plate projects from the side facing the free end portion of the relevant pin.

5. A colour display tube as claimed in claim 4, characterized in that the apertures in each resilient element in which the bent tags of the slide plate fit are slot-shaped, the and longitudinal axis of the apertures extend in a plane which is perpendicular to the longitudinal axis of the colour display tube.

6. A colour display tube as claimed in claim 5, characterized in that each slide plate is provided with two bent tags and a supporting portion.

7. A colour display tube as claimed in claim 6, characterized in that the resilient element is fixedly connected to the colour selection electrode at such an angle that a suitable pressure for the suspension from the pin is obtained.

8. A colour display tube as claimed in claim 6, characterized in that the resilient element is provided with limbs by means of which it is fixedly connected to the colour selection electrode.

9. A colour display tube as claimed in claim 1, characterized in that each slide plate comprises an at least partly conical portion having an aperture on at least one side of this portion, the free end portion of the relevant pin projecting from this aperture and lying against the conical portion to which it is rigidly secured.

10. A colour display tube as claimed in claim 1, characterized in that the free end portion of each pin is spherically shaped.

11. A color display tube as claimed in claim 1, characterized in that each resilient element is provided with a further aperture which is covered by the associated slide plate on the side facing the free end portion of the relevant pin, the aperture in the slide plate and the further aperture in the resilient element being located opposite one another.

12. A colour display tube as claimed in claim 1, characterized in that the apertures formed in each resilient element and in which the bent tags of the slide plate fit are slot-shaped, the longitudinal axis of the apertures extending in a plane which is perpendicular to the longitudinal axis of the colour display tube.

13. A colour display tube as claimed in claim 1, characterized in that each slide plate is provided with two bent tags and a supporting portion.

14. A colour display tube as claimed in claim 1, characterized in that the resilient element is fixedly connected to the colour selection electrode at such an angle that a suitable pressure for the suspension from the pin is obtained.

15. A colour display tube as claimed in claim 14, characterized in that the resilient element is provided with limbs by means of which it is fixedly connected to the colour selection electrode.

16. A method of manufacturing a colour display tube, the tube comprising an envelope having a substantially rectangular display window provided with an upright edge having pins secured in its corners, and a substantially rectangular colour selection electrode in which a plurality of apertures is formed, which colour selection electrode is provided with suspension means each of which comprises a resilient element which is fixedly connected to the colour selection electrode and a slide plate in which an aperture is formed, each pin having a free end portion for suspending the colour selection electrode in the corners of the upright edge, wherein the method comprises forming apertures in the resilient element, providing a slide plate with tags, slidably securing a slide plate onto the resilient element fitting the tags of the slide plate with clearance in the apertures of the resilient element, suspending a colour selection electrode in the display window, such that the free end portion of each pin projects from the aperture in the associated slide plate, and rigidly securing a slide plate to the flat resilient element, then rigidly securing each slide plate to the relevant pin whereby the colour selection electrode can be rapidly, stably and accurately suspended in the display window.

* * * * *